US007127187B2

(12) United States Patent
Mo et al.

(10) Patent No.: US 7,127,187 B2
(45) Date of Patent: Oct. 24, 2006

(54) TONE REPRODUCTION CURVE AND DEVELOPED MASS PER UNIT AREA CONTROL METHOD AND SYSTEM

(75) Inventors: Song-Feng Mo, Webster, NY (US); Wendy K. Apton, Webster, NY (US); Stephen F. Randall, West Henrietta, NY (US); Jennifer R. Wagner, Walworth, NY (US); David Clark Craig, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 138 days.

(21) Appl. No.: 11/032,716

(22) Filed: Jan. 11, 2005

(65) Prior Publication Data

US 2006/0153580 A1 Jul. 13, 2006

(51) Int. Cl.
*G03G 15/00* (2006.01)

(52) U.S. Cl. ..... 399/49; 399/46

(58) Field of Classification Search ..... 399/46, 399/48, 49, 50, 51, 53, 55, 72, 60
See application file for complete search history.

(56) References Cited

U.S. PATENT DOCUMENTS 5,710,958 A 1/1998 Raj
5,749,021 A * 5/1998 Mestha et al. ..... 399/49
5,895,141 A 4/1999 Budnik et al.
6,035,152 A * 3/2000 Craig et al. ..... 399/49
6,285,840 B1 9/2001 Budnik et al.
6,426,630 B1 7/2002 Werner, Jr.
6,580,882 B1 6/2003 Hirsch et al.
6,694,109 B1 2/2004 Donaldson et al.
6,741,816 B1 * 5/2004 Shim et al. ..... 399/49
6,771,912 B1 8/2004 Mo et al.
6,792,220 B1 9/2004 Randall et al.

* cited by examiner

*Primary Examiner*—Hoang Ngo
(74) *Attorney, Agent, or Firm*—Fay, Sharpe, Fagan, Minnich & McKee, LLP

(57) ABSTRACT

A method of controlling the solid developed mass per unit area and the tone reproduction curve in a printing machine by reading data from a sensor, comparing the data to an acceptable range of data values, where the data is not within the acceptable range of data values, updating a plurality of control actuators, determining whether the discharge ratio is within an acceptable range of discharge ratio values, where the discharge ratio is within the acceptable range of discharge ratio values, applying new control actuators to a power supply in the printing machine, and where the discharge ratio is not within the acceptable range of discharge ratio values, adjusting raster output scanner exposure per an exposure formula.

20 Claims, 3 Drawing Sheets

TONE REPRODUCTION CURVE AND DEVELOPED MASS PER UNIT AREA CONTROL METHOD AND SYSTEM

BACKGROUND

The present exemplary embodiment relates to tone reproduction curve control in an electrophotographic printing system, and it will be described with particular reference thereto. However, it is to be appreciated that the present exemplary embodiment is also amenable to other like applications.

Electrophotographic copiers, printers and digital imaging systems typically record an electrostatic latent image on an imaging member. The latent image corresponds to the informational areas contained within a document being reproduced. In xerographic systems, a uniform charge is placed on a photoconductive member and portions of the photoconductive member are discharged by a scanning laser or other light source to create the latent image. In ionographic print engines the latent image is written to an insulating member by a beam of charge carriers, such as, for example, electrons. However it is created, the latent image is then developed by bringing a developer, including colorants, such as, for example, toner particles into contact with the latent image. The toner particles carry a charge and are attracted away from a toner supply and toward the latent image by an electrostatic field related to the latent image, thereby forming a toner image on the imaging member. The toner image is subsequently transferred to a physical media, such as a copy sheet. The copy sheet, having the toner image thereon, is then advanced to a fusing station for permanently affixing the toner image to the copy sheet.

In xerographic print engines, a tone reproduction curve (TRC) is important in controlling the image quality of the output. An image input to be copied or printed has a specific tone reproduction curve. The image output terminal outputting a desired image has an intrinsic tone reproduction curve. If the image output terminal is allowed to operate uncontrolled, the tone reproduction curve of the image output by image output terminal will distort the rendition of the image. Thus, an image output terminal must be controlled to match its intrinsic tone reproduction curve to the tone reproduction curve of the input image. An intrinsic tone reproduction curve of an image output terminal may vary due to changes in such uncontrollable variables such as humidity or temperature and the age of the xerographic materials, i.e., the numbers of prints made since the developer, the photoreceptor, etc. were new.

Solid developed mass per unit area (DMA) control is a critical part of TRC control. If the DMA is too low then the images will be too light and customers will be dissatisfied. On the other hand, if the DMA is too high, then other xerographic or image quality problems, such as poor transfer efficiency, fusing defects, or toner scatter on lines, etc., can occur. High DMA will also increase the TCO (Total Cost to Owner). Maintaining a constant DMA or a low variation of DMA has always been a challenge in xerographic process controls design. Low cost reflection sensors, such as black toner area coverage (BTAC) sensors, cannot sense solid DMA due to sensor saturation at high masses. Currently, there are several different kinds of strategies to control DMA.

For example, one strategy has been to use $V_{dev}$ (development voltage) to control DMA. However, it is hard to control DMA within a small range since it may require a different $V_{dev}$ to achieve a similar DMA in different environmental zones or with different hardware configurations. Additionally, using measured $V_e$ (image voltage) to calculate $V_{dev}$ means some toner waste.

Another strategy has been to use a transmission densitometer to measure transmission density ($D_t$) from the photoreceptor belt in real-time. The $D_t$ is used to infer the DMA. However, the transmission densitometer is about eight to ten times more expensive than that of reflection sensors.

It is obvious that an improved method and system for controlling TRC and DMA by using a low cost reflection sensor, such as a black toner area concentration (BTAC) sensor, in products has significant benefits.

BRIEF DESCRIPTION

This exemplary embodiment describes an improved method of using a model-based discharge ratio (DR) control in the TRC controller to control DMA within a predefined range. An object of this exemplary embodiment is to control three TRC patches (light, mid-tone, and dark) within their tolerance ranges and, concurrently, to control DMA within the specification by using discharge ratio, which is controlled within a predefined range, based on PIDC model prediction. In order to achieve this goal, parameters in all TRC control modes are optimized, so that the charge level and exposure level are updated properly to keep the discharge ratio within range. The TRC controller algorithms check the discharge ratio every time the control actuators are updated. In the case of the discharge ratio being out of the range from one mode of the controller, the TRC controller will switch to another control mode automatically and ensure that discharge ratio is within range, so that both the TRC and DMA will be controlled within the specification ranges.

In accordance with one aspect of the present exemplary embodiment, there is provided a method of controlling the solid developed mass per unit area and the tone reproduction curve in an electrophotographic printing machine. The method comprises reading data from a sensor, comparing the data to an acceptable range of data values, where the data is not within the acceptable range of data values, updating a plurality of control actuators, determining whether the discharge ratio is within an acceptable range of discharge ratio values, where the discharge ratio is within the acceptable range of discharge ratio values, applying new control actuators to a power supply in the printing machine, and where the discharge ratio is not within the acceptable range of discharge ratio values, adjusting raster output scanner exposure per an exposure formula.

In accordance with another aspect of the present exemplary embodiment, there is provided a system for controlling the solid developed mass per unit area and the tone reproduction curve in an electrophotographic printing machine, the system comprising: an electrostatic voltmeter; an infrared densitometer; and software means operative on the electrophotographic print system for: reading data from a sensor; comparing the data to an acceptable range of data values; updating a plurality of control actuators, where the data is not within the acceptable range of data values; determining whether the discharge ratio is within an acceptable range of discharge ratio values; applying new control actuators to a power supply in the electrophotographic printing machine, where the discharge ratio is within the acceptable range of discharge ratio values; and adjusting raster output scanner exposure per an exposure formula, where the discharge ratio is not within the acceptable range of discharge ratio values.

DETAILED DESCRIPTION

Figure 1:
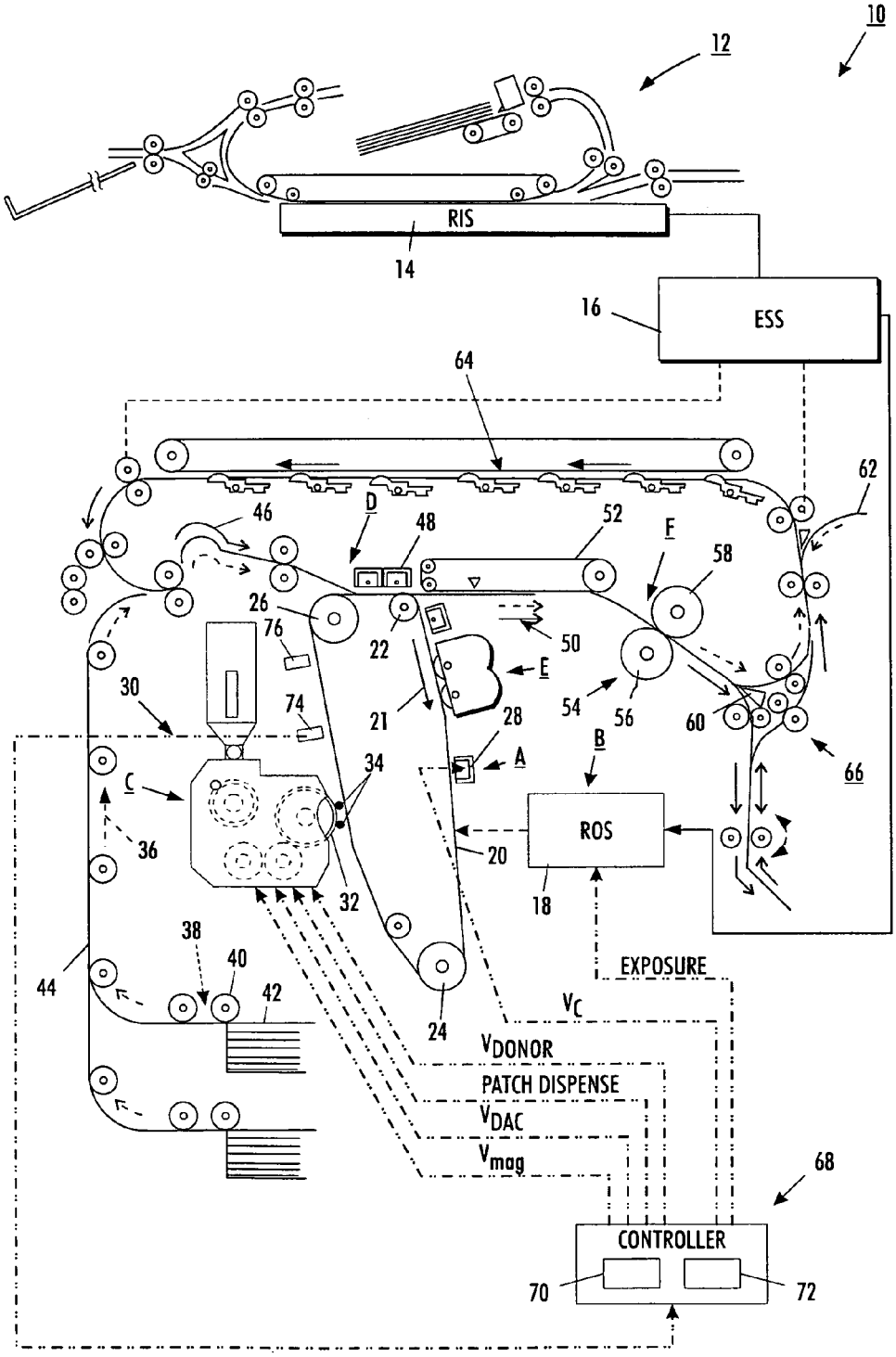
FIG. 1 is an example of an electrophotographic image forming system suitable for implementing aspects of the exemplary embodiment.

For a general understanding of the features of the present exemplary embodiment, reference is made to the drawings, wherein like reference numerals have been used throughout to designate identical elements. FIG. 1 schematically depicts the various elements of an illustrative electrophotographic printing machine 10 incorporating the method of the present exemplary embodiment therein. It will become evident from the following discussion that this method is equally well suited for use in a wide variety of printing machines and is not necessarily limited in its application to the particular embodiment depicted herein.

Inasmuch as the art of electrophotographic printing is well known, the various processing stations employed in the printing machine 10 will be shown hereinafter and their operation described briefly with reference thereto.

Referring to FIG. 1, an original document is positioned in a document handler 12 on a RIS 14. The RIS 14 contains document illumination lamps, optics, a mechanical scanning drive, and a charge-coupled device (CCD) array. The RIS 14 captures the entire original document and converts it to a series of raster scan lines. This information is transmitted to an electronic subsystem (ESS) 16, which controls a raster output scanner (ROS) 18 described below.

Generally, a photoconductive belt 20 is made from a photoconductive material coated on a ground layer, which, in turn, is coated on an anti-curl backing layer. The belt 20 moves in the direction of arrow 21 to advance successive portions sequentially through the various processing stations disposed about the path movement thereof. The belt 20 is entrained about a stripping roller 22, a tensioning roller 24, and a drive roller 26. As the drive roller 26 rotates, it advances the belt 20 in the direction of arrow 21.

Initially, a portion of the photoconductive surface passes through charging station A. At charging station A, a corona generating device 28 charges the photoconductive surface of the belt 20 to a relatively high, substantially uniform potential.

At exposure station B, the controller or electronic subsystem (ESS) 16 receives the image signals representing the desired output image and processes these signals to convert them to a continuous tone or gray-scale rendition of the image which is transmitted to a modulated output generator, for example the ROS 18. Preferably, the ESS 16 is a self-contained, dedicated minicomputer. The image signals transmitted to the ESS 16 may originate from the RIS 14 as described above or from a computer, thereby enabling the electrophotographic printing machine 10 to serve as a remotely located printer for one or more computers. Alternatively, the printer may serve as a dedicated printer for a high-speed computer. The signals from the ESS 16, corresponding to the continuous tone image desired to be reproduced by the printing machine, are transmitted to the ROS 18. The ROS 18 includes a laser with rotating polygon mirror blocks. The ROS 18 will expose the photoconductive belt to record an electrostatic image thereon corresponding to the continuous tone image received from the ESS 16. As an alternative, the ROS 18 may employ a linear array of light emitting diodes (LEDs) arranged to illuminate the charged portion of the photoconductive belt 20 on a raster-by-raster basis.

After the electrostatic latent image has been recorded on the photoconductive surface of the belt 20, the belt 20 advances the latent image to a development station C where, a development system 30 develops the latent image. Preferably, the development system 30 includes a donor roll 32, a magnetic transfer roll, and electrode wires 34 positioned in a gap between the donor roll 32 and the photoconductive belt 20. The magnetic transfer roll delivers toner to a loading zone (not shown) located between the transfer roll and the donor roll 32. The transfer roll is electrically biased relative to the donor roll 32 to affect the deposited mass per unit area (DMA) of toner particles from the transport roll to the donor roll 32. One skilled in the art will realize that both the donor roll and magnetic transfer roll have A.C. and D.C. voltages superimposed thereon. The electrode wires 34 are electrically biased relative to the donor roll 32 to detach toner therefrom and form a toner powder cloud in the gap between the donor roll 32 and the photoconductive belt 20. The latent image attracts toner particles from the toner powder cloud forming a toner powder image thereon.

With continued reference to FIG. 1, after the electrostatic latent image is developed, the toner image present on the belt 20 advances to transfer station D. A print sheet 36 is advanced to the transfer station D by a sheet feeding apparatus 38. Preferably, the sheet feeding apparatus 38 includes a feed roll 40 contacting the upper most sheet from stack 42. The feed roll 40 rotates to advance the uppermost sheet from the stack 42 into a vertical transport 44. The vertical transport 44 directs the advancing sheet 36 of support material into a registration transport 46 past image transfer station D to receive an image from the belt 20 in a timed sequence so that the toner powder image formed thereon contacts the advancing sheet at transfer station D. Transfer station D includes a corona generating device 48, which sprays ions onto the back side of the sheet 36. This attracts the toner powder image from the photoconductive surface of the belt 20 to the sheet 36. After transfer, the sheet 36 continues to move in the direction of arrow 50 by way of a belt transport 52, which advances the sheet 36 to fusing station F.

Fusing station F includes a fuser assembly 54, which permanently affixes the transferred toner powder image to the copy sheet 36. Preferably, the fuser assembly 54 includes a heated fuser roller 56 and a pressure roller 58, with the powder image, on the copy sheet 36, contacting the fuser roller 56.

The sheet 36 then passes through the fuser 54, where the image is permanently fixed or fused to the sheet 36. After the sheet 36 passes through the fuser 54, a gate 60 either allows the sheet 36 to move directly via an output 62 to a finisher or stacker, or deflects the sheet into the duplex path 64, specifically, into a single sheet inverter 66. That is, if the sheet 36 is either a simplex sheet, or a completed duplex sheet having both side one and side two images formed thereon, the sheet 36 will be conveyed via the gate 60 directly to the output 62. However, if the sheet 36 is being duplexed and is then only printed with a side one image, the gate 60 will be positioned to deflect that sheet 36 into the inverter 66 and into the duplex loop path 64, where that sheet 36 will be inverted and then fed for recirculation back through transfer station D and the fuser 54 for receiving and permanently fixing the side two image to the backside of that duplex sheet, before it exits via path 62.

After the copy sheet is separated from the photoconductive surface of the belt 20, the residual toner/developer and paper fiber particles adhering to the photoconductive surface are removed therefrom at cleaning station E. Cleaning station E includes a rotatably mounted fibrous brush in contact with the photoconductive surface of the belt 20 to disturb and remove paper fibers and a cleaning blade to remove the non-transferred toner particles. The blade may be configured in either a wiper or doctor position depending on the application. Subsequent to cleaning, a discharge lamp (not shown) floods the photoconductive surface of the belt 20 to dissipate any residual electrostatic charge remaining thereon prior to the charging thereof for the next successive imaging cycle.

The various machine functions are regulated by the ESS 16. The ESS 16 is preferably a programmable microprocessor, which controls all the machine functions described above. The ESS 16 provides a comparison count of the copy sheets, the number of documents being recirculated, the number of copy sheets selected by an operator, time delays, jam corrections, and etc. The control of all the exemplary systems described above may be accomplished by conventional control switch inputs from the printing machine console, as selected by the operator. Conventional sheet path sensors or switches may be utilized to keep track of the position of the original documents and the copy sheets.

In electrophotographic printing, toner material changes in the development system 30 and PIDC (Photo Induced Discharge Characteristics) changes in the photoconductive belt 20 influence the process. Aging and environmental conditions (that is, temperature and humidity) cause these changes. For example, after 200,000 copies, the PIDC of the photoconductive belt 20 is substantially different then when it was new. The tribo-electric charge on the toner material decays when the machine remains in non-print making condition. An idle period of 2–4 days reduces the charge by 8–10 tribo units. Thus, the machine has a set-up mode to adjust image quality output under different environmental conditions and age before real-time printing begins. The set-up mode does not pass paper through the machine. Instead it sets a plurality of nominal actuator values and sequentially performs one or more adjustment loops to obtain convergence on acceptable image quality parameters.

As shown in FIG. 1, there is provided an adaptive controller 68 that adjusts image quality during the set-up mode. The adaptive controller 68 has a plurality of outputs comprising state variables used as actuators to control a Tone Reproduction Curve (TRC). The real-time operation of the controller 68 is described in U.S. Pat. No. 5,436,705, which is incorporated by reference herein. The adaptive controller 68 may include a linear quadratic controller 70 and a parameter identifier 72 that divides the controller into the tasks of parameter identification and control modification. The state variable outputs of controller 68 include $V_C$, EXPOSURE, PATCH DISPENSE, $V_{DONOR}$, $V_{mag}$ and $V_{DAC}$. These outputs function as control actuators. After set up, these actuators are continuously updated as required during run time to maintain the TRC.

$V_C$ controls a power supply output (not shown) for the corona generating device 28. EXPOSURE controls the exposure intensity delivered by the ROS 18. PATCH DISPENSE controls the amount of dispensed toner required to compensate for toner test patch variations. $V_{DONOR}$ and $V_{DAC}$ control DC and AC power supply voltages (not shown) applied to the donor roll 32, respectively. $V_{mag}$ controls a DC power supply voltage (not shown) applied to the magnetic transfer roll in developer system 68. Control algorithms for the linear quadratic controller 70 and the parameter identifier 72 process information and adjust the state variables to achieve acceptable image quality during the set-up mode of machine operation.

In various exemplary embodiments, the changes in output generated by the controller 68 are measured by a black toner area coverage (BTAC) sensor 74. The BTAC sensor 74 is located after development station C. It is an infrared reflectance type densitometer that measures the density of toner particles developed on the photoconductive surface of belt 20. The manner of operation of the BTAC sensor 74 is described in U.S. Pat. No. 4,553,033, which is incorporated by reference herein.

It should be understood that the term black toner area coverage sensor or "densitometer" is intended to apply to any device for determining the density of print material on a surface, such as a visible-light densitometer, an infrared densitometer, an electrostatic voltmeter, or any other such device which makes a physical measurement from which the density of print material may be determined.

As shown FIG. 1, the electrophotographic printing machine 10 also includes an electrostatic voltmeter (ESV) 76. The electrostatic voltmeter 76 measures the voltage potential of control patches on the photoconductive surface 20 of the belt or drum. It is to be appreciated, however, that an ESV is not necessary, so as long as a PIDC model can be generated. An example of a suitable ESV 76 is described in U.S. Pat. No. 6,426,630, which is incorporated by reference herein.

Figure 2:
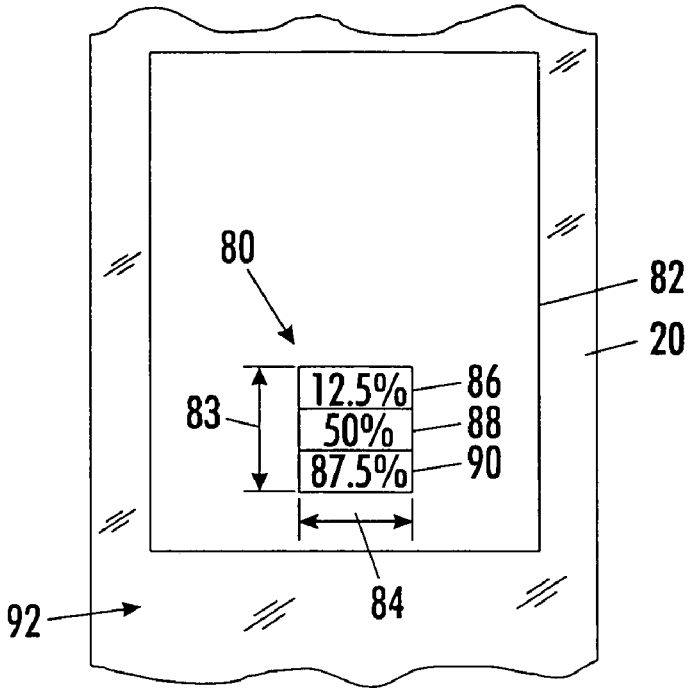
FIG. 2 shows a composite toner test patch recorded in the image zone of a photoconductive member.

Referring to FIG. 2, a composite toner test patch 80 is shown in an image area 82 of the photoconductive surface 20. The test patch 80 is that portion of the photoconductive surface 20 sensed by the BTAC sensor 74 to provide the necessary feedback signals for the set up mode. The composite patch 80 may measure, for example, 15 millimeters, in the process direction (indicated by arrow 83), and 45 millimeters, in the cross-process direction (indicated by arrow 84). The patch 80 consists of a segment 86 for highlight density (12.5%), a segment 88 for half-tone density (50%), and a segment 90 for solid area density (87.5%). Before the BTAC sensor 74 can provide a meaningful response to the relative reflectance of the patch segments, it must be calibrated by measuring the light reflected from a bare or clean area portion 92 of photoconductive surface 20. For sensor calibration purposes, current flow (in the light emitting diode internal to the TAG sensor) is increased until the voltage generated by the BTAC sensor 74 (in response to light reflected from area 92) is between 3 and 5 volts.

In order to offer customers value-added diagnostic services using add-on hardware and software modules which provide service information on copier/printer products, a hierarchy of machine servers may be used in accordance with this invention. In the following, "machine" is used to refer to the device whose performance is being monitored, including, but not limited to, a copier or printer. "Server" is used to refer to the device(s) that perform the monitoring and analysis function and provide the communication interface between the "machine" and the service environment. Such a server may comprise a computer with ancillary components, as well as software and hardware parts to receive raw data from various sensors located within the machine at appropriate, frequent intervals, on a continuing basis and to interpret such data and report on the functional status of the subsystem and systems of the machine. In addition to the direct sensor data received from the machine, knowledge of the parameters in the process control algorithms is also passed in order to acknowledge the fact that process controls attempt to correct for machine parameter and materials drift and other image quality affectors.

Figure 3:
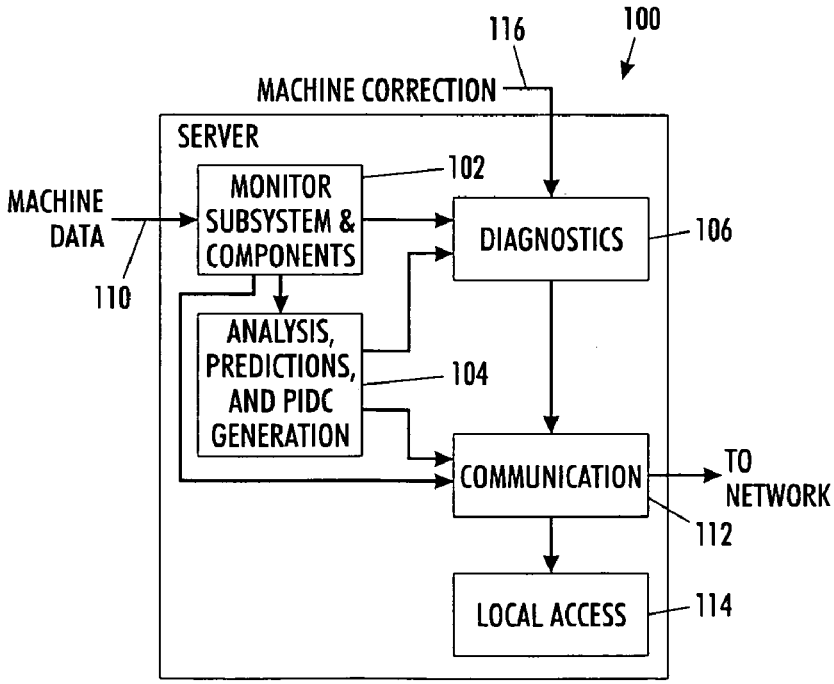
FIG. 3 is a schematic view of a machine server and interface in accordance with the exemplary embodiment.

In the exemplary embodiment shown in FIG. 3, a server 100 includes a subsystem and component monitor 102, an analysis and predictions component 104, a diagnostic component 106 and a communication component 108. It should be understood that suitable memory may be included in the server 100, the monitor 102, the analysis and predictions component 104, the diagnostics component 106 and the communication component 108. The monitor 102 contains a preprocessing capability including a feature extractor which isolates the relevant portions of data to be forwarded on to the analysis and diagnostic elements. In general, the monitor 102 receives machine data, as illustrated at 110, and provides suitable data to the analysis and predictions component 104 to analyze machine operation and status and track machine trends such as usage of disposable components as well as usage data, and component and subsystem wear data. Diagnostic component 106 receives various machine sensor and control data from the monitor 102, as well as data from the analysis and predictions component 104 to provide immediate machine correction, as illustrated at 116, as well as to provide crucial diagnostic and service information through communication component 108, for example, via a line 112 to an interconnected network to a remote server on the network or to a centralized host machine with various diagnostic tools such as an expert system. Such information may include suitable alarm condition reports, requests to replenish depleted consumable, and data sufficient for a more thorough diagnostics of the machine. A local access 114 or interface for a local service representative may be provided to access various analysis, prediction, and diagnostic data stored in the server 100, as well as to interconnect any suitable diagnostic device.

The transfer characteristic of the photoreceptor system is known as the photo-induced discharge curve (PIDC) and is a plot of the surface potential of the photoreceptor as a function of incident light exposure. The shape of this curve for a given photoreceptor depends on a number of factors, such as, for example, the field dependence, if any, of the photogeneration processes in the photoreceptor pigment, the field dependence of the efficiency of charge injection from the photoreceptor pigment into the photoreceptor transport layer, and the range, i.e., distance per unit field, of the charge carriers in the transport layer. In many practical photoreceptors, the photo-induced discharge curve is approximately linear with light exposure except at low voltages, which corresponds with exposure to high light intensities, where field dependent mechanisms decrease the rate of discharge. Determining the photo-induced discharge curve for a xerographic system is needed if the system is to operate around the optimum contrast potentials.

This exemplary embodiment proposes an improved method to control TRC and keep DMA within range using a low cost reflection sensor. Test results indicate that both TRC and DMA will be controlled within a predetermined range if all three TRC control patches (dark, mid-tone, and light) and the discharge ratio (DR) can be maintained within their tolerance ranges. From the test results, it was also discovered that the relationship between DMA and the discharge ratio is not linear if all three TRC control patches (dark, mid-tone, and light) are controlled within their tolerance ranges. Their relationship is shown in FIG. 4.

Figure 4:
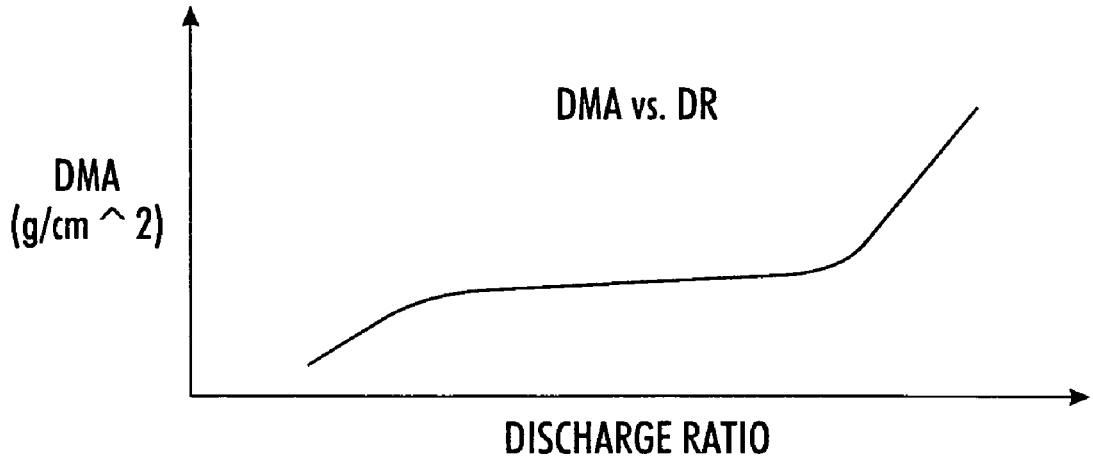
FIG. 4 is a graph of developed mass per unit area (DMA) versus discharge ratio.

It can be seen from FIG. 4 that the DMA decreases dramatically when the discharge ratio is too small and the DMA increases significantly when the discharge ratio is too high. A small discharge ratio causes lines to grow and a large discharge ratio causes line to shrink. When the discharge ratio is within a nominal range, the change of the DMA is very slow. Allowing a range of discharge ratios, instead of having a constant discharge ratio, will definitely help with the xerographic system latitude. Based on this discovery, a TRC controller has been designed and optimized, so that each controller mode will update charge grid and ROS exposure interdependently to keep the discharge ratio within a predefined range. When the regular controllers are not able to keep the discharge ratio within range, the TRC controller will be switched to a constant discharge ratio controller mode to enforce the discharge ratio within range. The ROS exposure level will be dependent on the $V_C$ level and the discharge ratio only, instead of laying out a solid image and using an ESV to read $V_e$. The PIDC model is used to predict $V_e$, to reduce the complexity of the system patch timing and save toner.

This exemplary embodiment proposes an improved TRC and DMA control strategy for a black and white xerographic printer and/or copier. This improved strategy requires only a low cost reflection sensor, such as a BTAC sensor, to control DMA and TRC within their specifications. It will also help reduce TCO (Total Cost to Owner) since only the necessary amount of DMA will be developed to meet image quality requirements.

Figure 5:
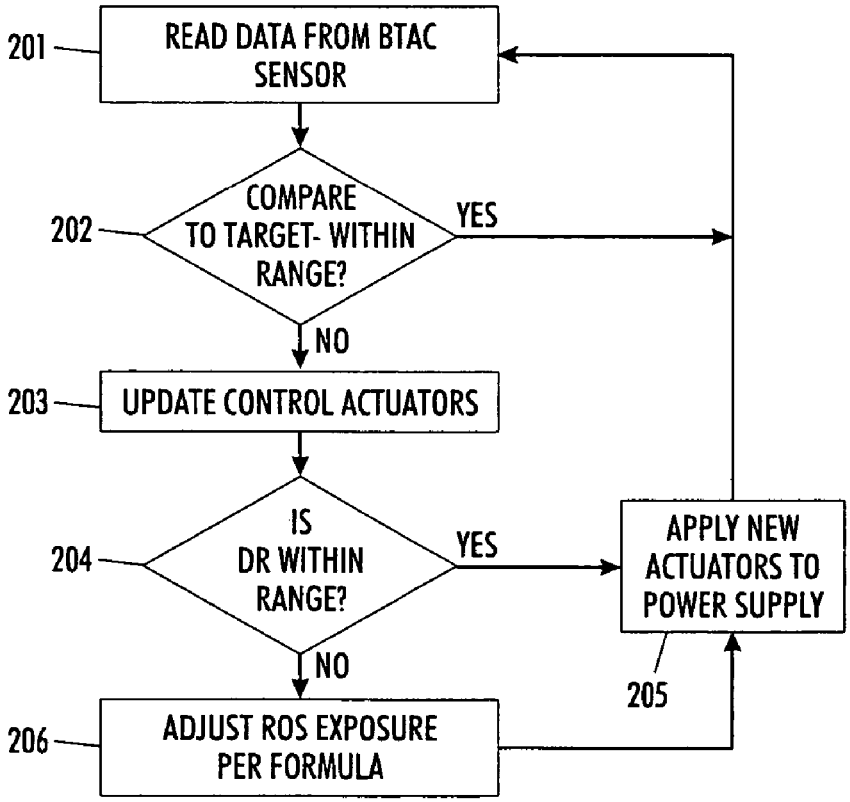
FIG. 5 is a flowchart outlining one exemplary method of using a model-based discharge ratio (DR) control in the TRC controller to control DMA within a predefined range.

An exemplary method of using a model-based discharge ratio (DR) control in the TRC controller to control DMA within a predefined range is outlined in FIG. 5. Initially, in step 201, three different half-tone patches (12.5%, 50%, and 87.5%) are produced. The relative reflectance (RR) of each patch is read by the BTAC sensor 74 as known in the art.

In step 202, the relative reflectance of each patch is compared to the target value, which is stored as NVM (non-vulnerable memory) in the printer 10. The target values are determined by empirical testing and comparing the output image quality of the TRC to a desired specification level. If the level of each patch is within a reasonable range, it is assumed the system is working well. No further steps are taken and the program continues to read data from the BTAC sensor 74, as in step 201.

On the other hand, if the data are not within the target range, then the control actuators ($V_C$, EXPOSURE, $V_{mag}$ and $V_{DAC}$) are updated (step 203). This may be accomplished by determining the directionality that the data are out of the target range and adjusting the power supplies accordingly via a controller board.

In step 204, the discharge ratio (DR) is checked while the process control is running to determine if the discharge ratio is within the desired range and to make process control adjustments if the discharge ratio is out of range. The discharge ratio is defined as follows:

$$DR=(|Ve|-|Vr|)/(|Vc|-|Vr|) \quad (1)$$

Where:

$V_e$ is the voltage image reading from the ESV 76 after raster output scanner exposure;

$V_r$ is the residual voltage on the photoreceptor at highest exposure and lowest charge level; and $V_C$ is the charge voltage reading from the ESV 76 when the raster output scanner 18 is off.

The following formula describes how to compute the raster output scanner exposure level based on $V_C$, DR, and the PIDC coefficients ($S_0$, k, $V_r$, and $V_{to}$):

$$\text{Exposure} = \frac{1}{S}\left[\left(\frac{(|Vc|-|Vr|)^2-|Vt|^2}{(|Vc|-|Vr|)}\right)-\left(\frac{(|Ve|-|Vr|)^2-|Vt|^2}{(|Ve|-|Vr|)}\right)\right] \quad (2)$$

In Eq. (2), the sensitivity coefficient S is defined as:

$$S=S_0*(1-e^{-k*|Vc|}) \quad (3)$$

where:

$S_0$ is the coefficient of the sensitivity coefficient S; and k is the degradation rate of the voltage on the photoreceptor belt 20.

In Eq. (2), the transition point $V_t$ is defined as:

$$V_t=V_{t0}*|V_c|; \quad (4)$$

where $V_{t0}$ is the coefficient of the transition point $V_t$.

In Eq. (2), the voltage image reading $V_e$ is defined as:

$$V_e=|V_r|-DR*(|V_c|-|V_r|) \quad (5)$$

$S_0$, k, $V_r$, and $V_{to}$ are the parameters from the PIDC model that may be generated as described in U.S. Pat. No. 6,771,912, which is incorporated by reference herein. DR in the formula above is either $DR_{min}$ or $DR_{max}$, depending on whether the DR is out of range low or high, respectively.

If the discharge ratio (DR) is within the desired range, then the new control actuators are applied to the appropriate power supply (step 205) via a controller board. (One power supply is near development station C and another power supply is near charging station A and exposure station B in the printer 10.) However, if the discharge ratio (DR) is not within the desired range, then the ROS exposure is adjusted per Eq. (2) by feeding back the information to the controller board and adjusting the exposure up or down accordingly. The photoreceptor discharge data may be obtained in any suitable manner, including by using an electrostatic voltmeter and the raster output scanner.

The exemplary TRC control method disclosed above is performed via embedded software in the print engine 10 and utilizes an infrared reflection densitometer (such as a BTAC sensor). An electrostatic voltmeter (ESV) in the system is preferred but not necessary, as long as the PIDC model can be generated.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications, variations, improvements, and substantial equivalents.

The invention claimed is:

1. A method of controlling the developed mass per unit area (DMA) and the tone reproduction curve (TRC) for a printing machine, the method comprising:

reading data from a sensor;

comparing the data to an acceptable range of data values;

updating a plurality of control actuators, where the data is not within the acceptable range of data values;

determining whether the discharge ratio is within an acceptable range of discharge ratio values;

applying new control actuators to a power supply in the printing machine, where the discharge ratio is within the acceptable range of discharge ratio values; and adjusting raster output scanner exposure per an exposure formula, where the discharge ratio is not within the acceptable range of discharge ratio values.

2. The method defined in claim 1, wherein the sensor is a black toner area concentration (BTAC) sensor.

3. The method defined in claim 1, wherein the data from the sensor includes the relative reflectance of three half-tone patches on a test patch, the half-tone patches comprising 12.5%, 50%, and 87.5%.

4. The method defined in claim 1, wherein the plurality of control actuators includes $V_c$, EXPOSURE, $V_{mag}$ and $V_{DAC}$.

5. The method defined in claim 1, further comprising updating the control actuators by determining the directionality that the data are out of the range and adjusting a plurality of power supplies in the printing machine via a controller board.

6. The method defined in claim 1, wherein the discharge ratio is defined as: DR=(|Ve|−|Vr|)/(|Vc|−|Vr|).

7. The method defined in claim 6, wherein:

$V_e$ is the voltage image reading from the ESV after raster output scanner exposure;

$V_r$ is the residual voltage on the photoreceptor at highest exposure and lowest charge level; and $V_c$ is the charge voltage reading from the ESV when the raster output scanner is off.

8. The method defined in claim 1, wherein the exposure formula is:

$$\text{Exposure} = \frac{1}{S}\left[\left(\frac{(|Vc|-|Vr|)^2-|Vt|^2}{(|Vc|-|Vr|)}\right)-\left(\frac{(|Ve|-|Vr|)^2-|Vt|^2}{(|Ve|-|Vr|)}\right)\right].$$

9. The method defined in claim 8, wherein:

the sensitivity coefficient S is defined as: $S=S_0*(1-e^{-k*|Vc|})$;

the transition point $V_t$ is defined as: $V_t=V_{t0}*|V_c|$; and the voltage image reading $V_e$ is defined as: $V_e=|V_r|+DR*(|V_c|-|V_r|)$.

10. The method defined in claim 1, wherein the printing machine comprises a xerographic printing machine.

11. A developed mass per unit area (DMA) and tone reproduction curve (TRC) control system for a printing machine, the system comprising:

an electrostatic voltmeter;

an infrared densitometer; and software means operative on the printing machine to:

read data from a sensor;

compare the data to an acceptable range of data values;

update a plurality of control actuators, where the data is not within the acceptable range of data values;

determine whether the discharge ratio is within an acceptable range of discharge ratio values;

apply new control actuators to a power supply in the printing machine, where the discharge ratio is within the acceptable range of discharge ratio values; and adjust raster output scanner exposure per an exposure formula, where the discharge ratio is not within the acceptable range of discharge ratio values.

12. The system defined in claim 11, wherein the sensor is a black toner area concentration (BTAC) sensor.

13. The system defined in claim 11, wherein the data from the sensor includes the relative reflectance of three half-tone patches on a test patch, the half-tone patches comprising 12.5%, 50%, and 87.5%.

14. The system defined in claim 11, wherein the plurality of control actuators includes $V_c$, EXPOSURE, $V_{mag}$ and $V_{DAC}$.

15. The system defined in claim 11, wherein the software means is also operative on the printing machine to update the control actuators by determining the directionality that the data are out of range and adjust a plurality of power supplies in the printing machine via a controller board.

16. The system defined in claim 11, wherein the discharge ratio is defined as: DR=(|Ve|−|Vr|)/(|Vc|−|Vr|).

17. The system defined in claim 16, wherein:

$V_e$ is the voltage image reading from the ESV after raster output scanner exposure;

$V_r$ is the residual voltage on the photoreceptor at highest exposure and lowest charge level; and $V_c$ is the charge voltage reading from the ESV when the raster output scanner is off.

18. The system defined in claim 11, wherein the exposure formula is:

$$\text{Exposure} = \frac{1}{S}\left[\left(\frac{(|Vc| - |Vr|)^2 - |Vt|^2}{(|Vc| - |Vr|)}\right) - \left(\frac{(|Ve| - |Vr|)^2 - |Vt|^2}{(|Ve| - |Vr|)}\right)\right].$$

19. The system defined in claim 17, wherein:

the sensitivity coefficient S is defined as: $S=S_0*(1-e^{-k*|V_c|})$;

the transition point $V_t$ is defined as: $V_t=V_{t0}*|V_c|$; and the voltage image reading $V_e$ is defined as: $V_e=|V_r|+DR*(|V_c|-|V_r|)$.

20. The system defined in claim 11, wherein the printing machine comprises a xerographic printing machine.

* * * * *